US012599199B2

(12) United States Patent
Garrard

(10) Patent No.: US 12,599,199 B2
(45) Date of Patent: Apr. 14, 2026

(54) ASSEMBLY FOR COUPLING AN AESTHETIC MEMBER TO AN ACCESSORY

(71) Applicant: Holly Garrard, Chicago, IL (US)

(72) Inventor: Holly Garrard, Chicago, IL (US)

( * ) Notice: Subject to any disclaimer, the term of this patent is extended or adjusted under 35 U.S.C. 154(b) by 0 days.

(21) Appl. No.: 18/591,421

(22) Filed: Feb. 29, 2024

(65) Prior Publication Data

US 2025/0275607 A1 Sep. 4, 2025

(51) Int. Cl.
*A43C 19/00* (2006.01)

(52) U.S. Cl.
CPC ..... *A43C 19/00* (2013.01)

(58) Field of Classification Search
CPC ..... A43C 19/00; A43B 23/24; A43B 3/24; A43B 3/242; A43B 3/0078
USPC ..... 36/136
See application file for complete search history.

(56) References Cited

U.S. PATENT DOCUMENTS

| | | | |
|---|---|---|---|
| 1,738,605 | A | 12/1929 | Myers et al. |
| D100,413 | S | 7/1936 | Clark |
| D270,779 | S | 10/1983 | Steinberg |
| 4,553,293 | A | 11/1985 | Blum |
| 4,879,787 | A | 11/1989 | Walls |
| 5,170,573 | A | 12/1992 | Clinch |
| D348,347 | S | 7/1994 | Krajci |
| 5,441,061 | A | 8/1995 | Jordan et al. |
| 5,566,475 | A | 10/1996 | Donnadieu |
| D397,544 | S | 9/1998 | Egelja |
| 5,996,261 | A | 12/1999 | Nelson |
| D424,795 | S | 5/2000 | Matis |
| 6,408,540 | B1 | 6/2002 | Dekalb et al. |
| D467,715 | S | 12/2002 | Finney |
| 6,546,649 | B1 | 4/2003 | Tobias |
| D495,855 | S | 9/2004 | Comeau |
| D511,883 | S | 11/2005 | Matis |
| D521,222 | S | 5/2006 | Choi |
| D525,016 | S | 7/2006 | Feller |
| D530,496 | S | 10/2006 | Choi |
| D535,467 | S | 1/2007 | Kelsey |
| D539,017 | S | 3/2007 | Matis et al. |
| D544,193 | S | 6/2007 | Choi |
| D554,349 | S | 11/2007 | Kelsey |
| D554,352 | S | 11/2007 | Choi |
| D554,844 | S | 11/2007 | Choi |

(Continued)

FOREIGN PATENT DOCUMENTS

| | | | |
|---|---|---|---|
| GB | 2416663 | A | 2/2006 |
| KR | 960000194 | U | 1/1996 |

OTHER PUBLICATIONS

ACBC, "Select Skin and Sole. Create your Shoe.," <http://acbc.al/> publicly available at least as early as Sep. 8, 2020.

(Continued)

*Primary Examiner* — Haley A Smith
(74) *Attorney, Agent, or Firm* — Command IP LLP; Pejman Yedidsion

(57) ABSTRACT

An assembly for coupling an aesthetic member to an accessory. The assembly may include a base configured to be secured to the accessory. The assembly may include a topper configured to be removably coupled to the base, the topper including the aesthetic member, wherein the topper is removable to interchange the aesthetic member from the accessory.

12 Claims, 9 Drawing Sheets

(56) References Cited

U.S. PATENT DOCUMENTS

D555,335 S 11/2007 He
D557,004 S 12/2007 Guers-neyrud
D558,437 S 1/2008 Wilkinson
D558,438 S 1/2008 Choi
D559,522 S 1/2008 Lawler
D560,892 S 2/2008 Belley et al.
D560,901 S 2/2008 Choi
D561,432 S 2/2008 He
D561,451 S 2/2008 Belley et al.
D562,540 S 2/2008 Guers-Neyrud
D563,645 S 3/2008 Horne et al.
D563,652 S 3/2008 Matis
D563,656 S 3/2008 Andersen et al.
D564,748 S 3/2008 Belley et al.
D568,592 S 5/2008 Choi
D572,458 S 7/2008 Choi
D572,896 S 7/2008 Choi
D578,295 S 10/2008 Guers-Neyraud
D578,748 S 10/2008 Banik
D581,648 S 12/2008 Guers-Neyraud
D581,651 S 12/2008 Belley et al.
D582,144 S 12/2008 Guers-Neyraud
D584,499 S 1/2009 Ringholz
D584,500 S 1/2009 Lawler
D584,501 S 1/2009 Guers-neyraud
D584,502 S 1/2009 Choi
D585,186 S 1/2009 Van Hulle
D586,983 S 2/2009 Van Hulle
D591,490 S 5/2009 Lawler
D592,392 S 5/2009 Wilkinson
D593,310 S 6/2009 St-Louis et al.
D593,743 S 6/2009 Belley et al.
D594,216 S 6/2009 Banik et al.
D598,559 S 8/2009 Powaser
D599,998 S 9/2009 Belley et al.
D600,436 S 9/2009 Guers-Neyraud
D624,295 S 9/2010 McCarron
D632,472 S 2/2011 Issler
D635,346 S 4/2011 Lonigan
D643,611 S 8/2011 Ringholz
D644,423 S 9/2011 Ringholz
D659,369 S 5/2012 Blakeslee
D665,562 S 8/2012 Di Nucci
D666,800 S 9/2012 Edwards
8,266,769 B2 9/2012 Murray et al.
D668,846 S 10/2012 Wang et al.
D668,851 S 10/2012 Wang et al.
D681,927 S 5/2013 Gavrieli et al.
8,453,356 B2 * 6/2013 Mian ..... A43B 1/0054 2/69
D696,844 S 1/2014 Curtis
D699,419 S 2/2014 Horn et al.
D702,035 S 4/2014 Larusso
8,935,859 B2 1/2015 Licht
D730,024 S 5/2015 McCusker-Short
D732,805 S 6/2015 Bruder
D736,504 S 8/2015 Guers-neyraud
9,095,185 B1 8/2015 Ortner
D738,598 S 9/2015 Sassi
D741,052 S 10/2015 Guers-Neyraud
D741,054 S 10/2015 Stillwagon
D744,737 S 12/2015 Raasch
D746,570 S 1/2016 Raasch
D747,090 S 1/2016 Raasch
9,259,055 B1 * 2/2016 Raynor ..... A43C 7/04
D750,359 S 3/2016 Osorio
D757,406 S 5/2016 Stillwagon
D759,950 S 6/2016 Larusso
D763,558 S 8/2016 Bacchin
D767,863 S 10/2016 Spring
D770,738 S 11/2016 Choi
D770,765 S 11/2016 Hanson
D773,789 S 12/2016 Slimane
D775,797 S 1/2017 Sassi
D782,165 S 3/2017 Slimane
D787,794 S 5/2017 Vega
D798,033 S 9/2017 Osorio
D799,193 S 10/2017 Kirschner
D801,647 S 11/2017 Mitchell et al.
D802,261 S 11/2017 Stillwagon
D802,265 S 11/2017 Kirkwood
D807,629 S 1/2018 Cochrane
D808,150 S 1/2018 Durflinger
D812,862 S 3/2018 Powell
D817,627 S 5/2018 Chang
9,955,757 B1 * 5/2018 Ng ..... A43B 23/24
D822,976 S 7/2018 Schultze
D824,653 S 8/2018 Denney
D826,537 S 8/2018 Petrie
D827,995 S 9/2018 Birman
D831,323 S 10/2018 Badinghaus
D831,941 S 10/2018 Cuini
D836,320 S 12/2018 Petrie
D838,443 S 1/2019 Whittington
D838,969 S 1/2019 Klein
D840,643 S 2/2019 Jeong
D847,473 S 5/2019 Negri et al.
D856,637 S 8/2019 Williams et al.
D857,349 S 8/2019 Louboutin
D858,075 S 9/2019 Schultze
D858,952 S 9/2019 Williams et al.
D866,132 S 11/2019 Vaccarello
D869,128 S 12/2019 Difrancisco
D869,840 S 12/2019 Chaney
10,499,710 B2 12/2019 Innocente
D876,757 S 3/2020 Hartmann
D882,240 S 4/2020 Khachatourian et al.
D883,617 S 5/2020 Spring
D886,432 S 6/2020 Dean
D888,379 S 6/2020 Janek
D890,503 S 7/2020 Devito
D899,054 S 10/2020 Adepoju
D902,566 S 11/2020 Kuerbis
D902,571 S 11/2020 Workman et al.
D925,201 S 7/2021 Yoo
D925,890 S 7/2021 Dieudonné
D927,153 S 8/2021 Bernardi
D929,708 S 9/2021 Shevchuk
D933,361 S 10/2021 Tzortzinakis
D943,960 S 2/2022 De Montgolfier
D948,179 S 4/2022 Vaccarello
D953,007 S 5/2022 Garrard
D957,802 S 7/2022 Garrard
D971,579 S 12/2022 Garrard
11,832,687 B2 12/2023 Van Hoesen
2006/0026861 A1 2/2006 Manzi
2007/0240335 A1 10/2007 Fitzgerald
2008/0022558 A1 1/2008 Kaufer
2008/0235992 A1 10/2008 Stefani
2009/0300948 A1 12/2009 Nordstrom-wehner
2010/0037486 A1 2/2010 Verheijen
2010/0047604 A1 2/2010 Stratton-metzger
2010/0058619 A1 3/2010 Ferrante et al.
2010/0122474 A1 * 5/2010 Wolf ..... A43B 3/0078 36/100
2010/0275464 A1 11/2010 Mian
2011/0041363 A1 * 2/2011 Stanfield ..... A43B 1/0054 36/11.5
2012/0174442 A1 7/2012 Castle
2012/0204441 A1 8/2012 Conner et al.
2012/0246974 A1 10/2012 Hammerslag et al.
2012/0285046 A1 11/2012 Chapin et al.
2013/0025165 A1 1/2013 Hunter et al.
2013/0047387 A1 * 2/2013 Gervase ..... A43B 3/105 24/586.11
2013/0108884 A1 5/2013 Lillich
2013/0333242 A1 12/2013 Whiting
2014/0000126 A1 1/2014 Nelson-warren
2015/0000160 A1 1/2015 Giraldo et al.
2015/0075035 A1 3/2015 Wreede
2015/0272276 A1 10/2015 Brown
2015/0320141 A1 11/2015 Collins et al.
2016/0044990 A1 2/2016 Georgeson
2016/0255915 A1 9/2016 Dames-Coppe

(56) References Cited

U.S. PATENT DOCUMENTS

| | | | | |
|---|---|---|---|---|
| 2018/0303194 | A1 | 10/2018 | Naughton | |
| 2018/0310668 | A1 | 11/2018 | Argueta Morales et al. | |
| 2018/0317617 | A1 | 11/2018 | Rendon et al. | |
| 2019/0142112 | A1 | 5/2019 | Ramsay et al. | |
| 2020/0268110 | A1 | 8/2020 | Travieso et al. | |
| 2021/0127779 | A1* | 5/2021 | Haehn | A43B 3/0078 |
| 2021/0330039 | A1* | 10/2021 | Cureton | A43C 19/00 |
| 2021/0386160 | A1 | 12/2021 | Luna | |
| 2022/0039511 | A1 | 2/2022 | Mokoski | |
| 2023/0346080 | A1 | 11/2023 | Garrard | |

OTHER PUBLICATIONS

Author Unknown, "Image of Red Shoes with Jewelry on Strap," publicly available at least as early as Sep. 8, 2020.

Author Unknown, "Image of Red Shoes with Strap and Ribbon Above Heel," publicly available at least as early as Sep. 8, 2020.

Cicihot, "Zipper Lace Up High Top Wedge Sneaker," publicly available at least as early as Sep. 8, 2020.

Oesh, "Healthy by Design, Shoes for Women," <https://oeshshoes.com/> publicly available at least as early as Sep. 8, 2020.

Rothy's, "Washable, Woven Flats & Shoes Made from Recycled Plastic," <https://rothys.com/> publicly available at least as early as Sep. 8, 2020.

Steve Madden, "Sane Black Nubuck Variant," publicly available at least as early as Sep. 8, 2020.

International Search Report and Written Opinion for Application No. PCT/US2025/017154 dated Mar. 19, 2025 (11 pages).

* cited by examiner

ASSEMBLY FOR COUPLING AN AESTHETIC MEMBER TO AN ACCESSORY

FIELD

The present application relates to an assembly for coupling an aesthetic member to an accessory (e.g., shoes, hand bags, belts, hats, and the like) or item of clothing. In particular, the present application relates to an assembly for removably coupling an aesthetic member to a shoe.

BACKGROUND

Shoes are intended to protect and comfort the human foot when making contact with the ground. Shoes are also used as a fashion article. Fashion has often dictated many shoe design elements, such as types of materials, colors, heel heights, and flexibility. Additionally, fashion accessories, such as hand bags, belts, hats, and the like are added to change the look or appearance of a person.

Fashion is one of the primary contributors to pollution, creating 10% of worldwide greenhouse gas emissions annually and negatively impacting our global crisis of climate change. Accordingly, a quick and easy way to add an aesthetic member to change the appearance of an accessory (e.g., shoes, hand bags, belts, hats, and the like) would be desirable and important to reducing the impact of fashion on pollution. Additionally, the ability to reuse the aesthetic member on different types of accessories (e.g., shoes, hand bags, belts, hats, and the like) would be cost effective for the user while providing an endless number of options.

SUMMARY

In some aspects, the techniques described herein relate to an assembly for coupling an aesthetic member to an accessory, the assembly including: a base configured to be secured to the accessory; a topper configured to be removably coupled to the base, the topper including the aesthetic member; wherein the topper is removable to interchange the aesthetic member from the accessory.

In some aspects, the techniques described herein relate to an accessory system including: an accessory; a base configured to be coupled to the accessory; a first topper configured to be removably coupled to the base, the first topper including a first aesthetic member; a second topper configured to be removably coupled to the base, the second topper including a second aesthetic member that is different form the first aesthetic member, wherein the first topper is removable and replaceable with the second topper to modify the accessory from having the first aesthetic member to the second aesthetic member.

In some aspects, the techniques described herein relate to a method for altering a design of an accessory, the method including: providing a base coupled to the accessory; coupling a first topper to the base, the first topper including a first aesthetic member such that the accessory has a first design; removing a first topper from a base; and coupling a second topper to the base, the second topper having a second aesthetic member such that the accessory has a second design.

Other aspects of the present disclosure will become apparent by consideration of the detailed description and accompanying drawings.

DETAILED DESCRIPTION

Before any embodiments of the application are explained in detail, it is to be understood that the application, and the devices and method described herein, are not limited in their application to the details of construction and the arrangement of components set forth in the following description or illustrated in the following drawings. The devices and methods in this application are capable of other embodiments and of being practiced or of being carried out in various ways.

Figure 1:
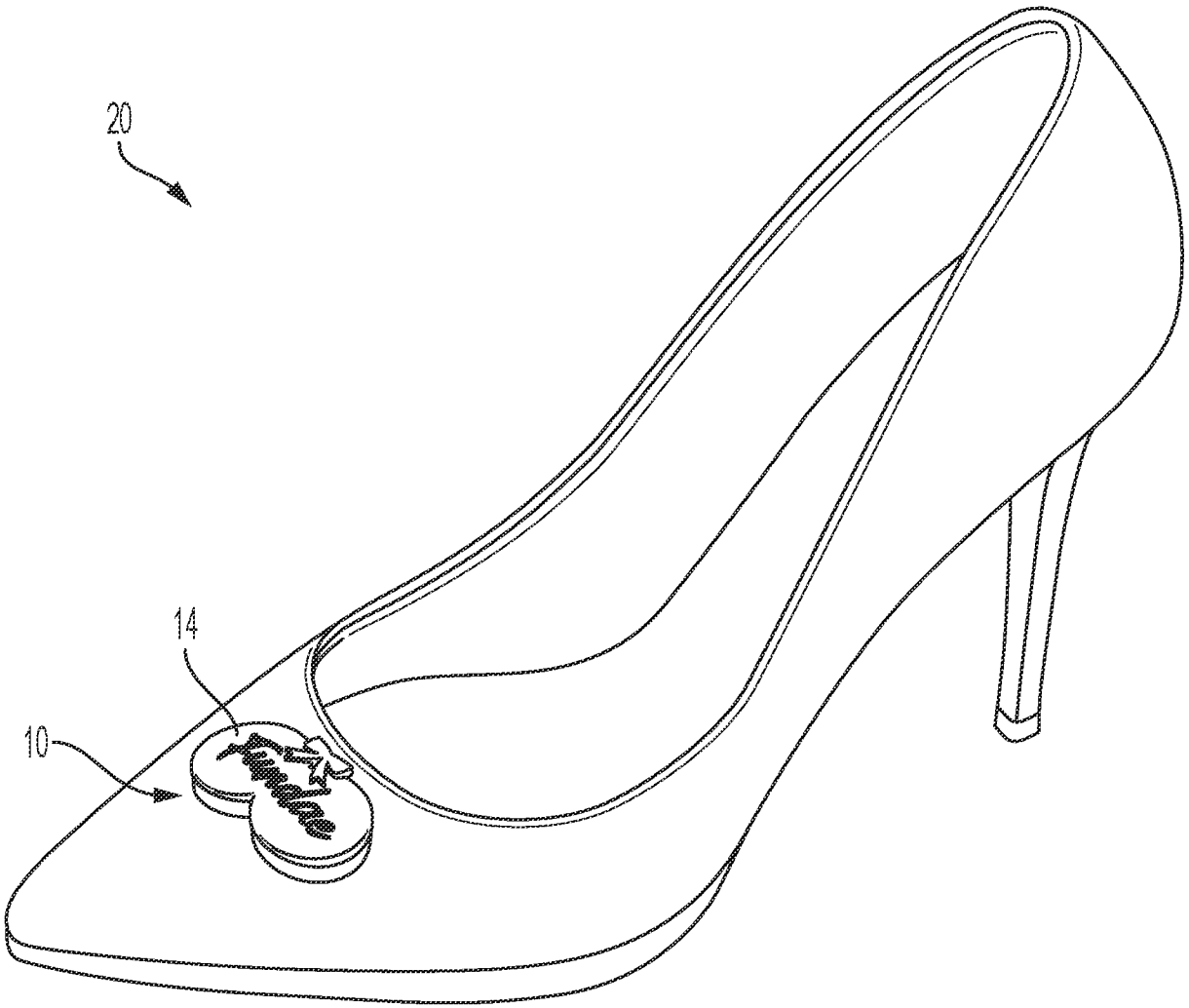
FIG. 1 illustrates a perspective view of an accessory including an assembly for coupling an aesthetic member to the accessory.
Figure 2:
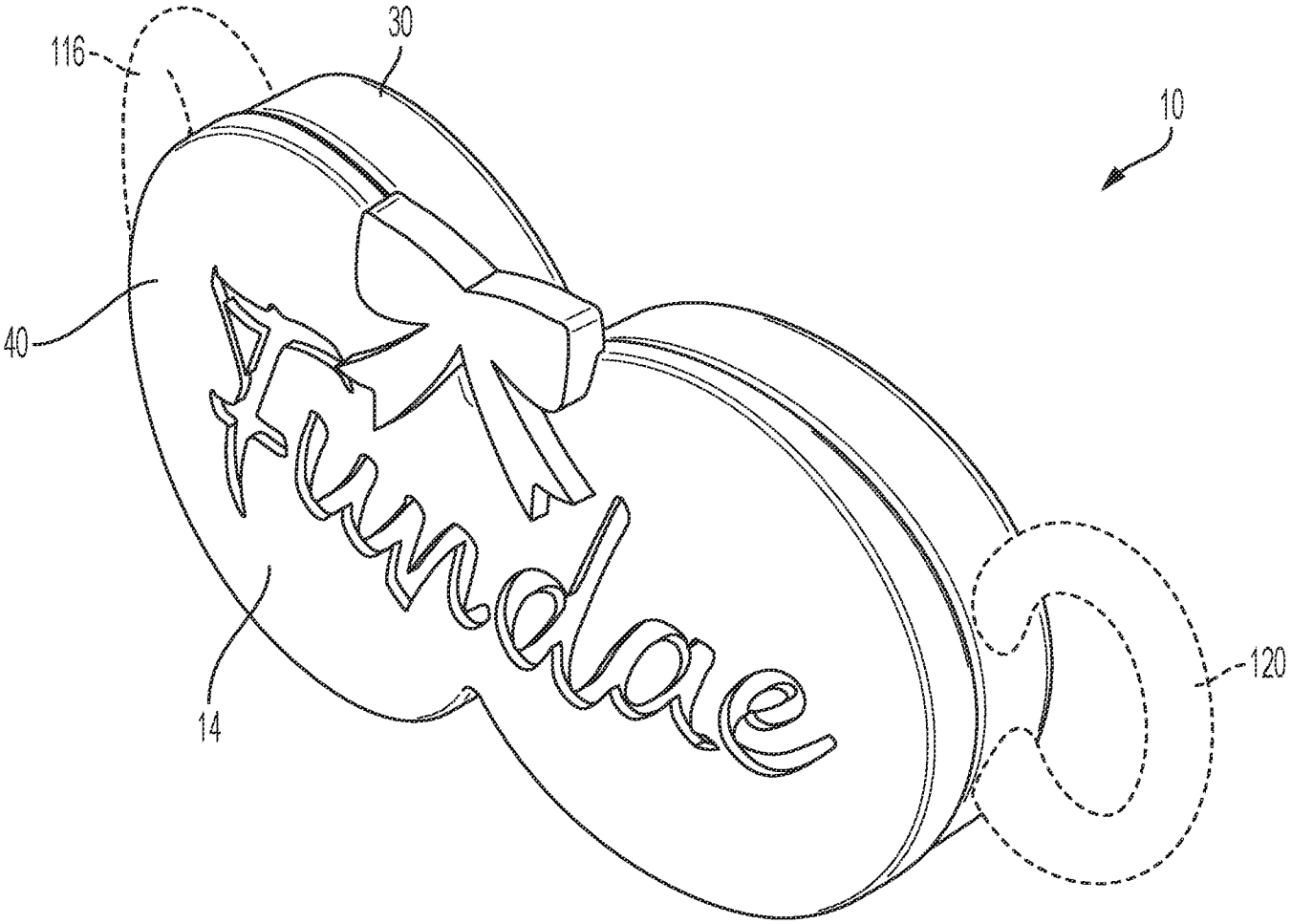
FIG. 2 illustrates a perspective view of the assembly of FIG. 1 including a base and a topper according to an embodiment.
Figure 3:
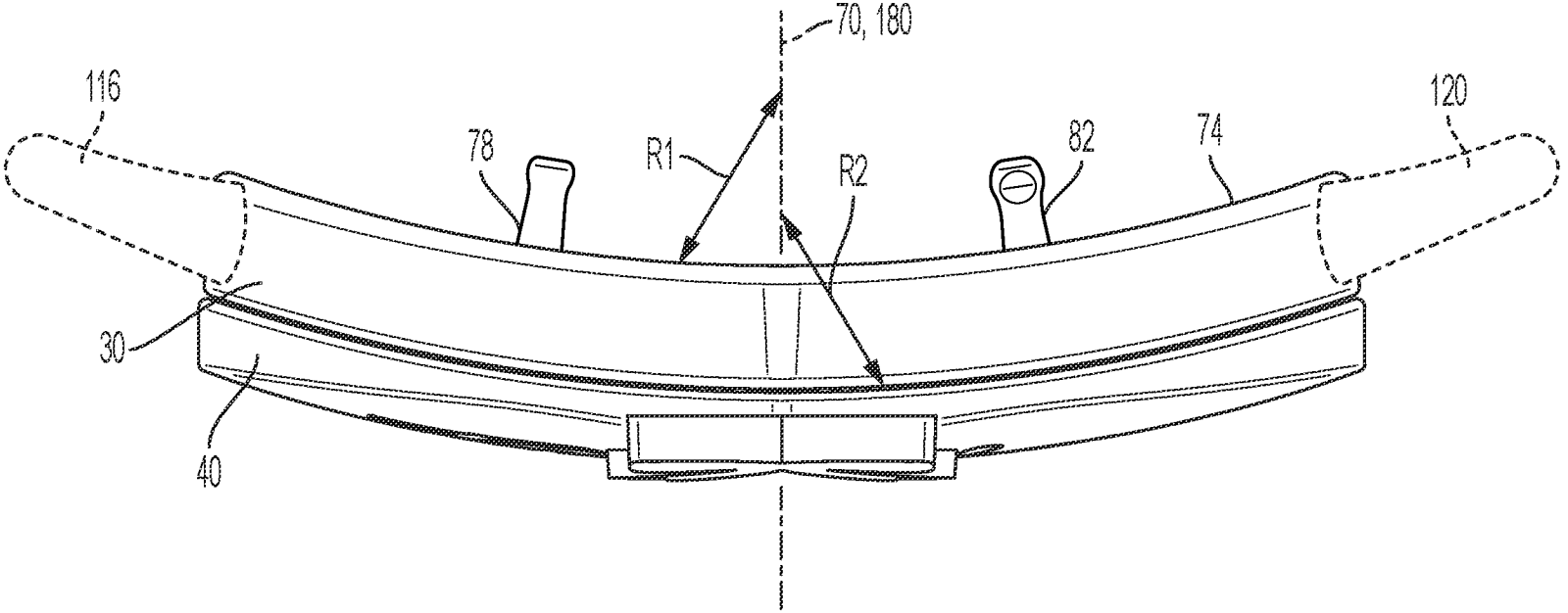
FIG. 3 illustrates a side view of the assembly of FIG. 1.

FIG. 1 illustrates an assembly 10 for removably and interchangeably coupling an aesthetic member 14, 14', 14" to an accessory 20. In the embodiment illustrated herein, the accessory 20 is a shoe. In other or alternative embodiments, the assembly 10 may be used with another accessory (such as a handbag, belt, hat, etc.) or item of clothing (e.g., a dress, suit jacket, etc.). As shown in FIGS. 2-5, the assembly 10 includes a base 30 and a topper 40. The base 30 is configured to be coupled to the accessory 20, and the topper 40 is configured to be removably coupled to the base 30. The topper 40 includes the aesthetic member 14, such that the aesthetic member 14 is removably coupled to the accessory 20. With respect to FIG. 8, the topper 40 is removable and replaceable with another topper 40', 40", each having another aesthetic member 14' 14", as will be discussed in greater detail below, to quickly and easily alter the design or look of the accessory 20. In the illustrated embodiments, the base 30 and the topper 40 have the embodied shape, but it should be understood that the base 30 and the topper 40 may have any suitable shape.

With respect to FIGS. 2-6, the base 30 includes a body 50 having a first side 54, a second side 58 opposite the first side 54, a third side 62, and a fourth side 66 opposite the third side 62. The base 30 may be coupled to the accessory 20 via a rivet, adhesive, or other suitable coupling mechanism, as discussed in greater detail below. The coupling mechanism secures the base 30 to the accessory 20 such that the base remains in place for when the topper 40 is added and removed.

The first side 54 includes a first surface 74 that is configured to be positioned adjacent an outer surface of the accessory 20. The first surface 74 is configured to contact an outer surface of the shoe 20, such that the first surface 74 abuts the outer surface of the shoe 20. The first surface 74 may also include a first projection 78 (e.g., post) and a second projection 82 (e.g., post) extending therefrom. In the illustrated embodiment, the projections 78, 82 are part of the coupling mechanism. That is, the projections 78, 82 are configured to be a rivet foot and therefore each include an aperture extending through 86, 90 that is configured to receive and secure a cap (not shown). Although not shown, when coupled to the shoe, the projections 78, 82 may extend into and/or through a portion of the shoe such that the base 30 is positioned adjacent and contacts the outer surface of the shoe. The caps may be coupled to the projections 86, 90 from within the shoe and positioned adjacent an inner surface of the shoe to couple the base 30 to the shoe. In other embodiments, there may be a single projection or more than two projections. In other embodiments, the projections 78, 82 may be omitted such that the first surface 74 is generally smooth. In such case, the base 30 may be coupled to the shoe in other ways using other or additional coupling mechanisms, as discussed below.

In the illustrated embodiment, the body 50 is generally curved such that the second surface 74 is a generally arcuate surface. That is, the body 50 has a radial concavity having a radius R1 (FIG. 3) measured from a point on an axis 70 that extends through the body 50 from the first side 54 to the second side 58. The radial concavity of the body 50 enables the first surface 74 of the base 30 to contact a curved outer surface of the shoe. In other embodiments, the body 50 may have a radial concavity having a different radius R1. Alternatively, in other embodiments, the body 50 may not be curved, such that the first side 54 has a generally planar surface.

The second side 58 includes a second surface 100 that is configured to face outwardly from the accessory 20. In the illustrated embodiment, the second side 58 also includes a first recess 104 and a second recess 108. The first recess 104 is positioned adjacent the third side 62 and the second recess 108 is positioned adjacent the fourth side 66. A lip 112 extends about both the first recess 104 and the second recess 108 and is recessed relative to the second surface 100. In other constructions, the second side may include a single recess or more than two recesses.

Figure 8:
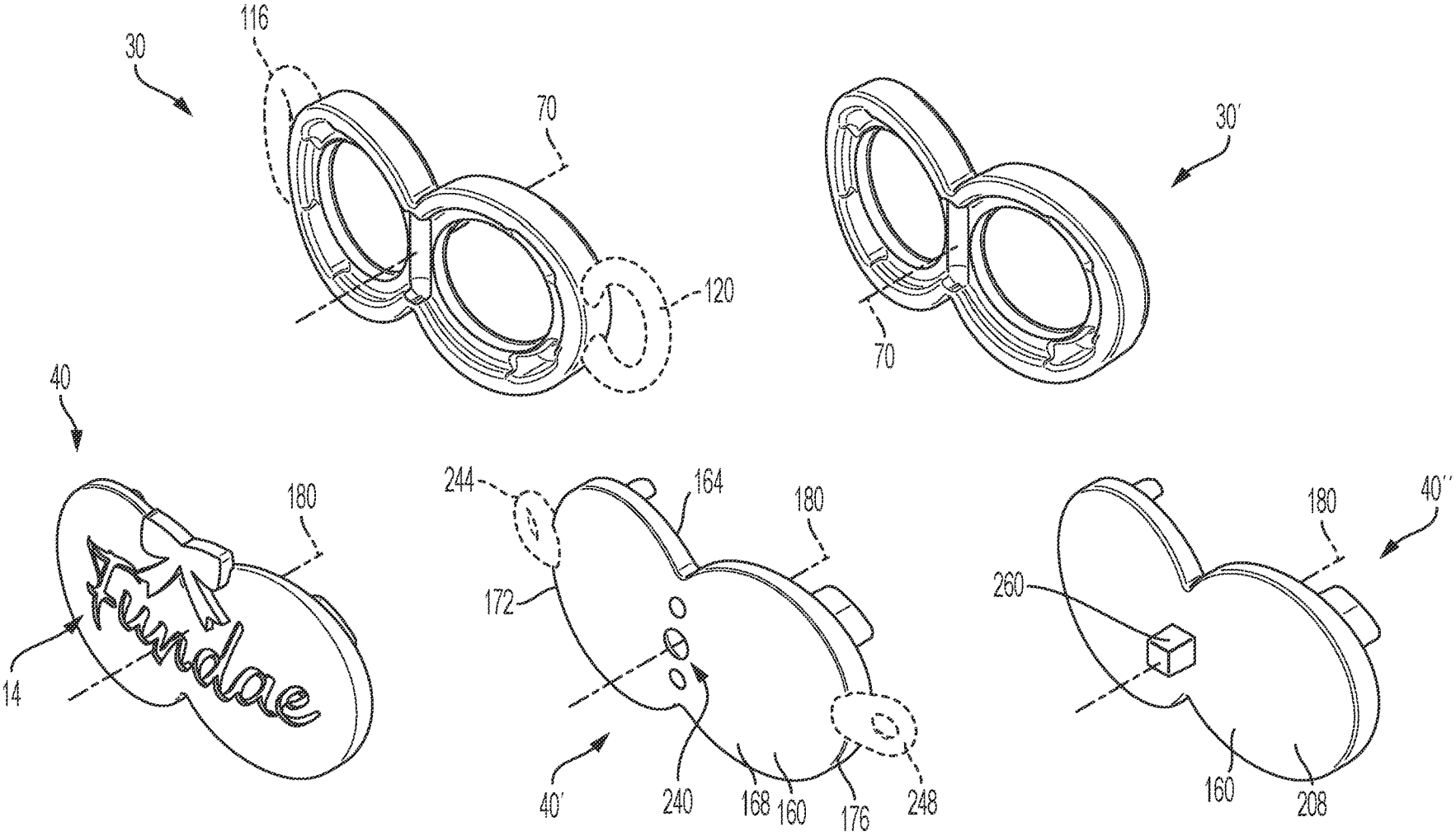
FIG. 8 illustrates a kit including a plurality of bases and a plurality of toppers for use with any of the plurality of bases.

As shown herein, the base 30 may additionally or alternatively include a first loop 116 coupled to and extending from the third side 62 and a second loop 120 coupled to an extending from the fourth side 120. The loops 116, 120 may be used to couple the base 30 to the shoe 20, in addition to or alternatively than the projections 86, 90. That is, in some embodiments, the loops 116, 120 may be sewn to the shoe 20 to couple the base 30 to the shoe 20. In other embodiments, the loops 116, 120 may be used to thread one or more straps therethrough (e.g., in the front at or adjacent to a toe region of the shoe, in the rear at or adjacent to an ankle region of the shoe, or anywhere in between the front and rear of the shoe). In some constructions, the first loop 116 and the second loop 120 are integral or formed with the base 30. In some embodiments, the base 30' may have an alternative configuration in which the loops 116, 120 may be omitted therefrom (FIG. 8). When omitted, the base 30 may be riveted to the shoe (as discussed above). Alternatively, the base 30, 30' may be coupled to the shoe in other suitable ways, such as by welding, adhesive, or another suitable method.

Figure 6:
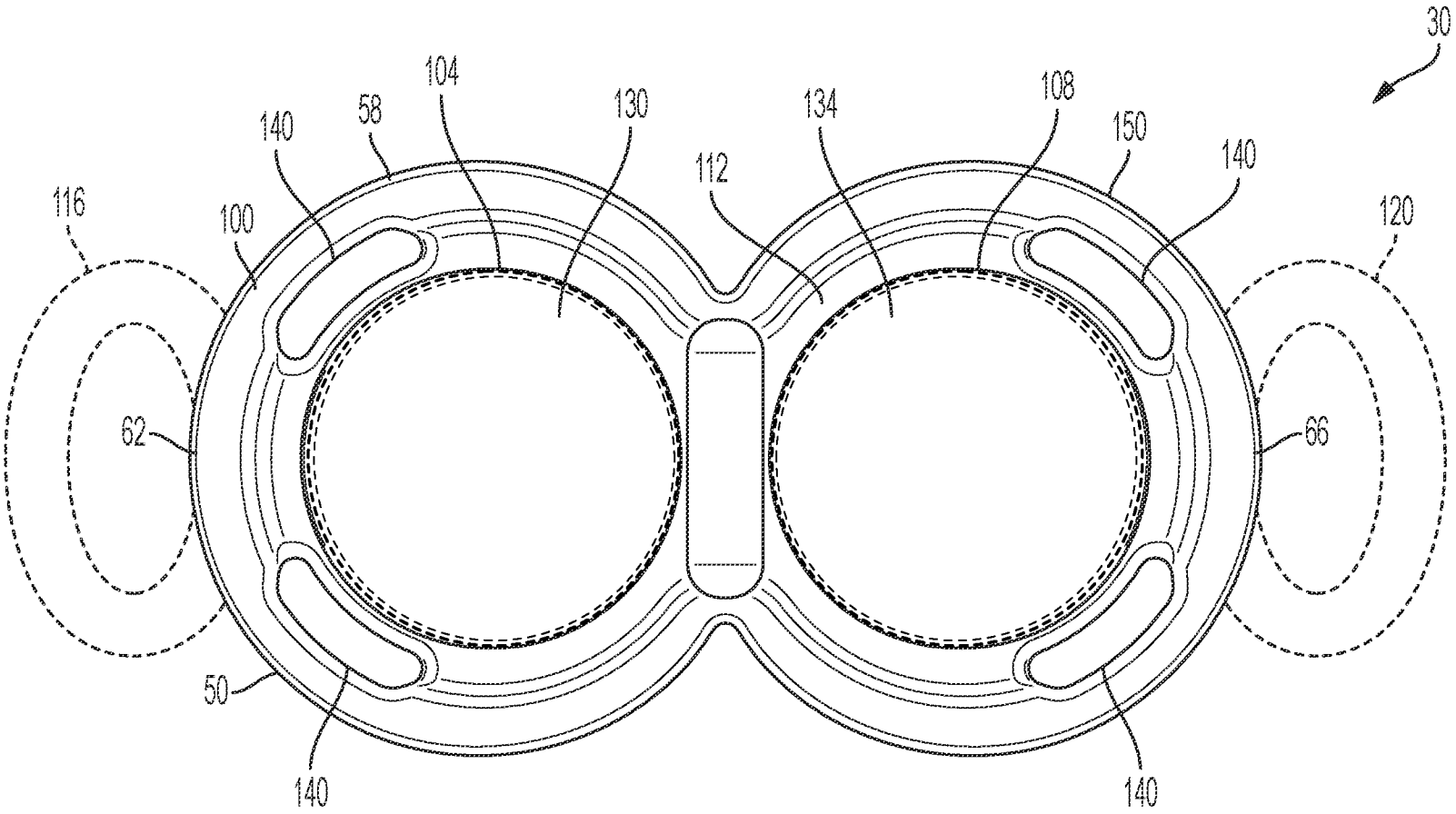
FIG. 6 illustrates a top view of the base of FIG. 1.
Figure 7:
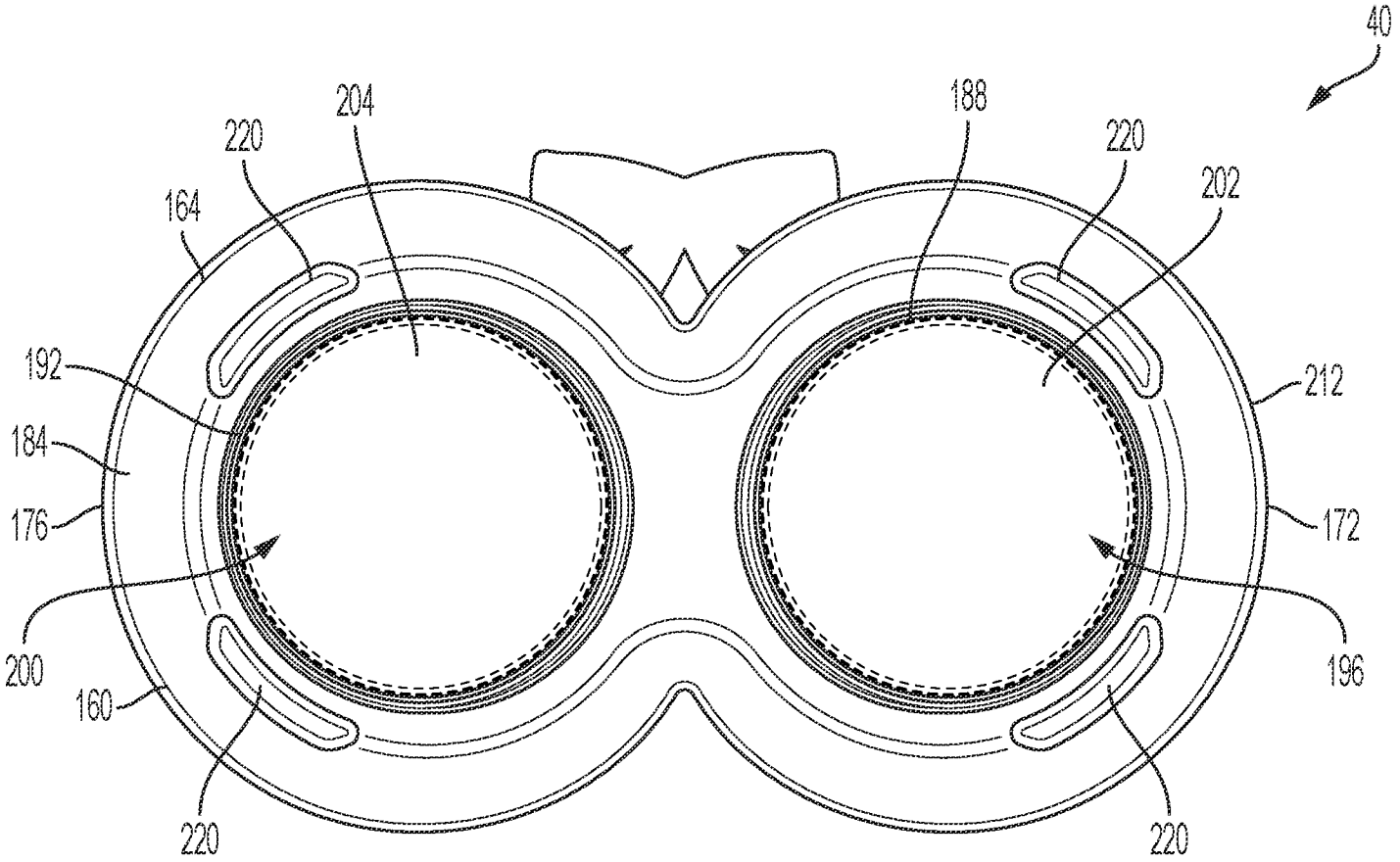
FIG. 7 illustrates a rear view of the topper of FIG. 1.

With respect to FIG. 6, in the illustrated embodiment, the base 30 includes a first magnet 130 and a second magnet 134. The first magnet 130 is received in the first recess 104 and the second magnet 134 is received in the second recess 108. In the illustrated embodiment, the magnets 130, 134 may be flush with the lip 112 or below the lip 112. Alternatively, the magnets 130, 134 may extend from the respective recess 104, 108 such that they project above the lip 112. In other embodiments, the base 30 may have other suitable configurations that accommodate one or more magnets. For example, the base 30 may include a single recess and a single magnet or may include a single recess and multiple magnets.

Figure 4:
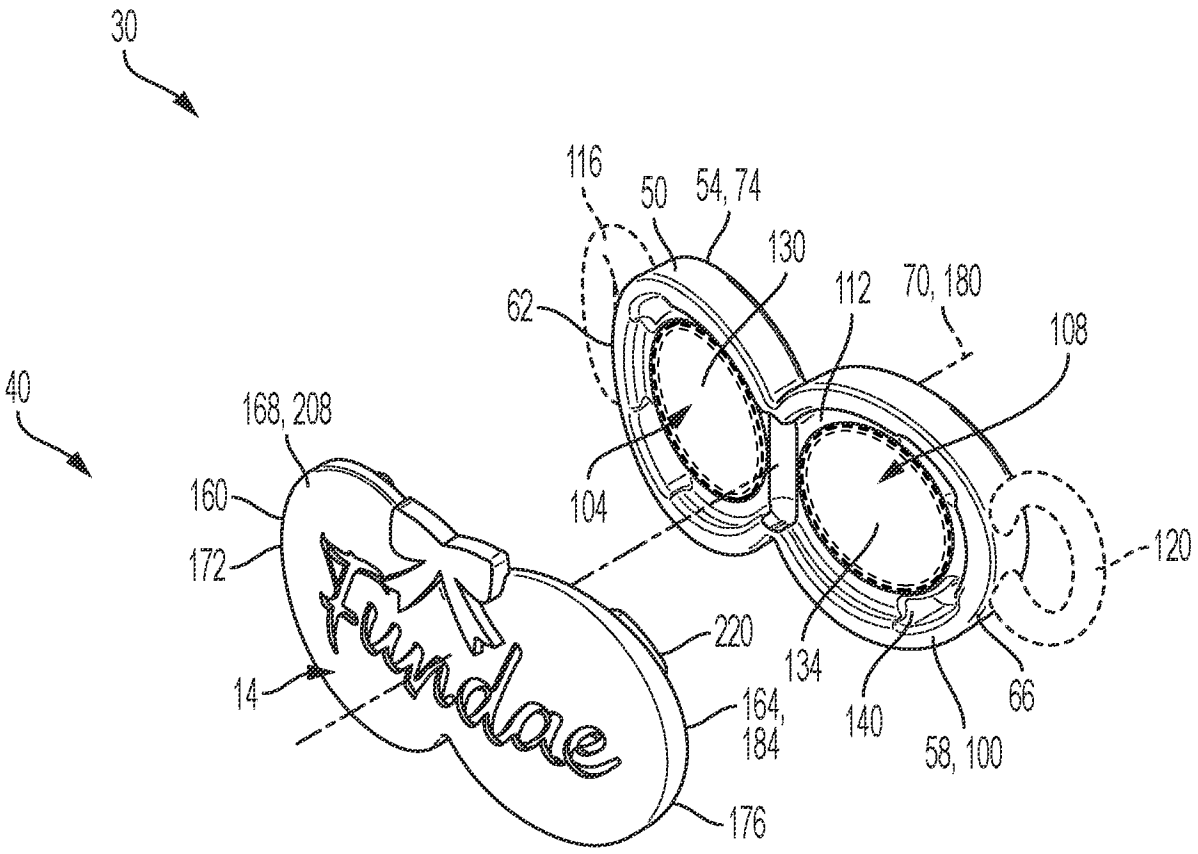
FIG. 4 illustrates an exploded view of the assembly of FIG. 1.
Figure 5:
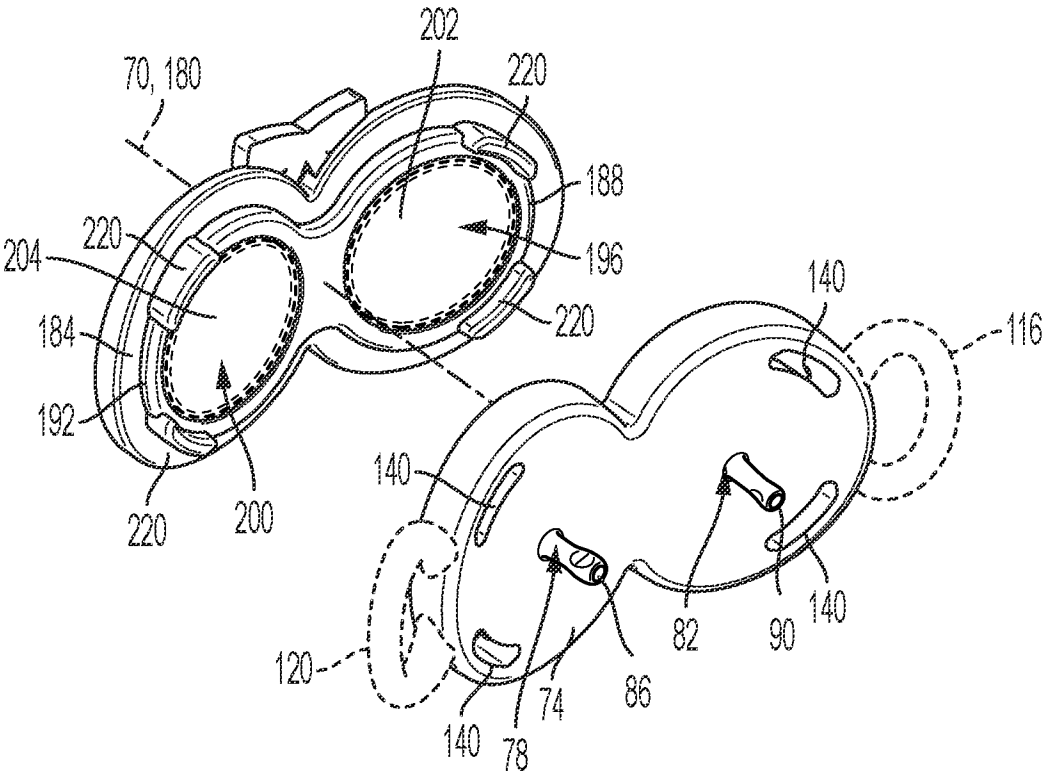
FIG. 5 illustrates another exploded view of the assembly of FIG. 1.

Also, with respect to FIGS. 4 and 5, in the illustrated embodiment, the base 30 has a plurality of apertures 140 that extend through the body 50 from the first side 54 to the second side 58. In other embodiments, the apertures 140 may be bores with an open end in the second side 58 and a closed end, such that the bore does do not extend all the way from the second side 58 through the body 50. The apertures 140 are positioned between the recesses 104, 108 and a peripheral edge 150 of the body 50. There are four apertures 140 in the illustrated embodiments. There are two apertures 140 that are positioned adjacent the third side 62 and two apertures 140 that are positioned adjacent the fourth side 66. In other embodiments, there may be more or fewer apertures 140 positioned at various locations adjacent the peripheral edge 150 of the body 50. In other embodiments, these apertures 140 may be omitted.

With respect to FIGS. 2-5 and 7, the topper 40 includes a body 160 having a first side 164, a second side 168 opposite the first side 164, a third side 172, and a fourth side 176 opposite the third side 172. The first side 164 of the topper 40 includes a first surface 184 and the second side 168 includes a second surface 208 that is configured to face outwardly from the accessory 20. A first projection 188 and a second projection 192 extend from the first surface 184. The first and second projections 188, 192 each include a recess 196, 200.

In the illustrated embodiment, each of the recesses 196, 200 includes a magnet 202, 204. In other embodiments, there may be more or fewer recesses 196 and more or fewer magnets 202, 204. The magnets 202, 204 are configured to attract to the respective magnets 130, 134 of the base 30. Accordingly, the magnets of the topper 40 align with and contact the magnets 130, 134 of the base 30 to couple the topper 40 to the base 30. When the topper 40 is coupled to the base 30, the projections 188, 192 are configured to be seated against (e.g., contact) the lip 112 and the first surface 184 of the topper 40 contacts the second surface 100 of the base 30. In the illustrated embodiment, a peripheral edge 212 of the topper 40 extends beyond the peripheral edge 150 of the base 30.

In the other embodiments, the magnets 202, 204 may be omitted such that the recesses 196, 200 are empty. In such case, when the topper 40 is coupled to the base 30, the recess 196 of the first projection 188 is configured to receive or be positioned adjacent to the first magnet 130 and the recess 200 of the second projection 192 is configured to receive or be positioned adjacent to the second magnet 134. Additionally, the topper 40 may be at least partially formed from metal such that the magnets 130, 134 attract to the topper 40 to secure the topper 40 to the base 30. Still, when the topper 40 is coupled to the base 30, the projections 188, 192 are configured to be seated against (e.g., contact) the lip 112 and the first surface 184 of the topper 40 contacts the second surface 100 of the base 30.

In the illustrated embodiment, the body 160 of the topper 40 is configured to be matingly coupled to the body 50 of the base 30. Accordingly, the body 160 of the topper 40 is generally curved, such that the first surface 184 is a generally arcuate surface. That is, the body 160 has a radial concavity having a radius R2 (FIG. 3) measured from a point on an axis 180 that extends through the body 160 from the first side 164 to the second side 168. In the illustrated embodiment, the radial concavity of the topper 40 is the same as the radial concavity of the base 30, such that radius R2 is equal to R1. In other embodiments, like the body 50 of the base 30, the body 160 of the topper 40 may have a radial concavity having a different radius R2. Alternatively, as noted above, in other embodiments, the body 160 may not be curved, such that the first side 184 has a generally planar surface.

In the illustrated embodiment, the first and second projections 188, 192 of the topper 40, collectively, may be considered an alignment feature of the topper 40, while the lip 112 of the base 30 may be considered to be an alignment feature of the base 30. That is, the first and second projections 188, 192 are configured to be matingly seated against the lip 112 to align, and therefore properly position, the topper 40 relative to the base 30.

Also, with respect to FIGS. 4 and 5, in the illustrated embodiment, the topper 40 includes a plurality of peripheral projections 220 extending from the first surface 184 of the topper 40. Each of the peripheral projections 220 are configured to be received in one of the apertures 40 (or bores) of the base 30. The number of peripheral projections 220 of the topper 40 therefore corresponds to the number of apertures 140 in the base 30. In other embodiments, there may be more apertures 40 than peripheral projections 220, such that the peripheral projections 220 may be received in some of the apertures 40, while others of the apertures 40 may not receive anything. That is, any number of the apertures 40 may be used to receive a peripheral projection 220 depending on the weight of the aesthetic member 14, 14', 14". In other words, a heavier aesthetic member may require more peripheral projections 220 to be received in more apertures 40, whereas a lighter aesthetic member may require less peripheral projections 220 to be received in less apertures 40. Also, these peripheral projections 220 may be omitted in some embodiments. Collectively, the peripheral projections 220 may be considered another alignment feature of the topper 40, while, collectively, the apertures 140 of the base 30 may be considered another alignment feature of the base 30. In the illustrated embodiment, there are four peripheral projections 220 and four apertures 140. In other or additional embodiments, there may be more (e.g., more than four) or fewer (e.g., less than four) peripheral projections 220 and apertures 140. Additionally, as shown herein, the base 30 and the topper 40 are symmetrical. Therefore, the topper 40 may be coupled to base 30 in a first orientation or a second orientation which is rotated 180 degrees relative to the first orientation.

In the illustrated embodiment, the user may be alerted to the proper engagement between the topper 40 and the base 30 by an audible sound. That is, coupling the topper 40 to the base 30 causes the audible sound. Similarly, there is an audible sound when the topper 40 is removed from the base 30.

As shown in FIG. 1, the second surface 208 of the topper 40 includes the aesthetic member 14. Accordingly, when the topper 40 is coupled to the base 30, and therefore the accessory 20, the aesthetic member 14 of the topper 40 is part of the design of the accessory 20. Additionally, because the base 30 and the topper 40 are symmetrical, the topper 40 may be coupled to base 30 such that the aesthetic member 14 can be in the first orientation or the second orientation. The user can remove the topper 40 to remove the aesthetic member 14 from the accessory 20. Also, as shown in FIG. 8, the topper 40' is interchangeable with the other toppers 40', 40" to change the aesthetic member 14 and therefore the design of the accessory 20. Although only the specific details of the base 30 and the topper 40, it should be understood that, except as otherwise noted, the base 30' has the same features as the base 30 and the toppers 40', 40" have the same features as the topper 40. One or both of the bases 30, 30' and one or more of the toppers 40, 40', 40" may therefore form a kit.

In the examples shown herein, the topper 40 of FIGS. 1-5 and 7-8 is a first topper 40. The second surface 208 of the first topper 40 includes the first aesthetic member 14. In this case the first aesthetic member 40 is indicia 230 (e.g., logos, letters, numbers, symbols, etc.) that is formed on the second surface 208 of the first topper 40. The indicia 230 may be integrally formed with or otherwise coupled to (e.g., by adhesive, welding, fastening, etc.) the first topper 40. In the first orientation, the indicia 230 may be considered upside down from the perspective of the user, while in the second orientation, the indicia 230 may be considered right side up from the perspective of the user.

Further with respect to FIG. 8, the first topper 40 is configured to be removed and replaced with a second topper 40'. The second topper 40' may include a first coupling configuration that is configured to secure a second aesthetic member (e.g., a bow, flower, rhinestone, buckle, feather, etc., not shown). The first coupling configuration may include a plurality of apertures 240 extending through the body 160 from the first side 164 to the second side 168. In the illustrated embodiment, there are three apertures 240 arranged at a midpoint between the third side 172 and the fourth side 176. The center aperture 240 has a greater diameter than the apertures 240 on either side thereof. The apertures 240 may have other configurations, orientations, and sizes. For example, the apertures 240 may be positioned in other locations relative the body 160 and/or there may be more or fewer apertures 140 having various sizes. Additionally, the first coupling configuration may include a first loop 244 coupled to and extending from the third side 172 and a second loop 248 coupled to and extending from the fourth side 176. The apertures 240 and/or the loops 244, 248 may be used to together or separately to couple the second aesthetic member to the second topper 40'. The second aesthetic member may be coupled to the topper 40 (and in particular to one or more of the apertures 240 and/or loops 244, 248) in any suitable way (e.g., sewn, riveted, welded, straps threaded therethrough, adhesively, etc.).

Further with respect to FIG. 8, the first topper 40 or the second topper 40' are each configured to be removed and replaced with a third topper 40". The third topper 40" may include a second coupling configuration that is configured to secure a third aesthetic member (e.g., a bow, flower, rhinestone, buckle, feather, etc., not shown). The second coupling configuration may include a projection 260 extending from the second surface 208. In the illustrated embodiment, the projection 260 is arranged at a midpoint between the third side 172 and the fourth side 176. The projection 260 may positioned in other locations relative the body 160, the projection 260 may have other suitable sizes and shapes (e.g., rectangle, oval, triangle, trapezoidal, etc.), and/or there may be additional projections 260 having various shapes and sizes. The projection 260 may be used to couple the third aesthetic member to the third topper 40". Although not shown, the third topper 40", like the second topper 40', may also include loops 244, 248. The third aesthetic member may be coupled to the topper 40 (and in particular to the projection 260 and/or loops 244, 248 thereof) in any suitable way (e.g., sewn, riveted, welded, straps threaded therethrough, etc.). In still some embodiments, the projection 260 may be omitted entirely and/or include loops 244, 248. In such case, the third aesthetic member may be coupled to the topper 40 (and in particular to the top surface and/or loops 244, 248 thereof) in any suitable way (e.g., sewn, riveted, welded, straps threaded therethrough, etc.).

Figure 9:
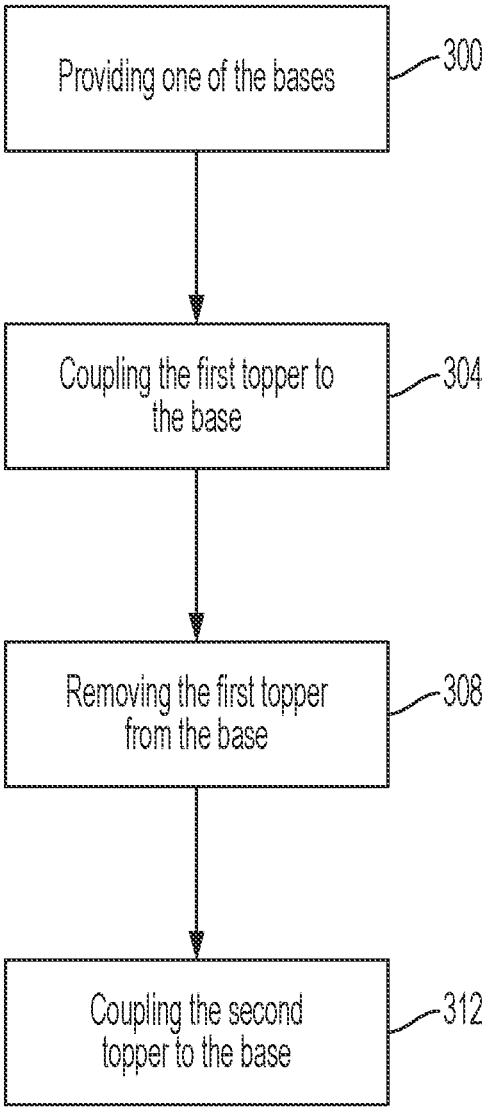
FIG. 9 is an exemplary method for altering the design of an accessory.

One exemplary method for altering a design of an accessory 20 (e.g., a shoe) is shown in FIG. 9. The method is discussed in the context of the altering the design of the accessory 20, which in this example is a shoe. In other embodiments, this method may be used for altering the design of another accessory (e.g., a handbag or a hat, etc.) or an item of clothing (e.g., a dress or suit jacket, etc.). At step 300, the method includes providing one of the bases 30, 30' of FIG. 8 to the accessory 20. At step 304, the method further includes coupling the first topper 40 to the base 30, 30'. The first topper 40 has the first aesthetic member 14. At step 308, the method includes removing the first topper 40 from the base 30, 30'. At step 312, the method includes coupling the second topper 40' to the base 30, 30'. The second topper 40' has the second aesthetic member 14'. As noted above, coupling the first topper 40 to the base 30, 30' and coupling the second topper 14' to the base includes magnetically coupling the first topper 40 to the base 30 and magnetically coupling the second topper 40' to the base 30, 30'. Additionally, in the embodiments herein, the method also includes aligning the first alignment feature of the first topper 40 with the second alignment feature of the base 30, 30' to couple to the first topper 40 to the base 30, 30', and aligning the first alignment feature of the second topper 40' with the second alignment feature of the base 30, 30' to couple to the second topper 40' to the base 30, 30'. Finally, the method also includes creating an audible sound when the first topper 40 is coupled to the base 30, 30' and creating the audible sound when the second topper 40' is coupled to the base 30, 30'. This same method may be repeated for removing the second topper 40' and replacing the second topper 40' with the third topper 40".

The assembly and system of this disclosure are designed to be inherently and intentionally eco-friendly and sustainable. That is, the assembly and system of this disclosure provide the utility and global potential for formerly single-use accessories to become multiuse and help reduce over-consumption, especially on the larger accessories, by just interchanging the toppers to change the aesthetic members attached to the accessories. Furthermore, in some cases, the waste from manufacturing the accessory (e.g., the shoe) may be used to create the aesthetic member of the topper 40, 40', 40" to further promote sustainability. The system created here for standardizing an assembly for coupling aesthetic members to accessories, therefore, has a potentially positive global impact to reduce waste and help slow climate change. A system such as this is much needed in the fashion industry.

Various features and advantages of the present disclosure are set forth in the following claims.

What is claimed is:

1. An assembly for coupling an aesthetic member to an accessory, the assembly comprising:

a base configured to be secured to the accessory, the base including a first recess configured to receive a first magnet, and an aperture or a bore formed in the base adjacent a peripheral edge of the base;

a topper configured to be removably coupled to the base, the topper including the aesthetic member, a second recess configured to receive a second magnet, and a protrusion extending from a peripheral edge of the topper, the protrusion configured to be received by the aperture or the bore of the base:

wherein the topper is removable to interchange the aesthetic member from the accessory; and wherein the base has a radial concavity that is same as the radial concavity of the topper.

2. The assembly of claim 1, wherein the topper is a first topper and the aesthetic member is a first aesthetic member, and further comprising a second topper having a second aesthetic member, the second topper configured to be removably coupled to the base when the first topper is removed from the base.

3. The assembly of claim 2, wherein the first aesthetic member is indicia formed on a top surface of the first topper.

4. The assembly of claim 2, wherein the second topper includes a coupling configuration that is configured to secure the second aesthetic member to the second topper.

5. The assembly of claim 1, wherein the base includes a first alignment feature and the topper includes a second alignment feature, the first alignment feature and the second alignment features configured to matingly engage to couple the topper to the base.

6. The assembly of claim 1, wherein the topper is magnetically coupled to the base.

7. An accessory system comprising:

an accessory:

a base configured to be coupled to the accessory, the base including a first recess configured to receive a first magnet, and an aperture or a bore formed in the base adjacent a peripheral edge of the base:

a first topper configured to be removably coupled to the base the first topper including a first aesthetic member, a second recess configured to receive a second magnet, and a first protrusion extending from a peripheral edge of the topper, the first protrusion configured to be received by the aperture or the bore of the base;

a second topper configured to be removably coupled to the base, the second topper including a second aesthetic member that is different from the first aesthetic member, a third recess configured to receive a third magnet, and a second protrusion extending from a peripheral edge of the second topper, the second protrusion configured to be received by the aperture or the bore of the base, wherein the first topper is removable and replaceable with the second topper to modify the accessory from having the first aesthetic member to the second aesthetic member; and wherein the base has a radial concavity that is the same as a radial concavity of each of the first topper and the second topper.

8. The accessory system of claim 7, wherein the first aesthetic member is indicia formed on a top surface of the first topper.

9. The accessory system of claim 7, wherein the second topper includes a coupling configuration that is configured to secure the second aesthetic member thereto.

10. The accessory system of claim 7, wherein the base includes a first alignment feature and each of the first topper and the second topper include a second alignment feature, the first alignment feature and the second alignment features configured to matingly engage to couple the respective first topper and second topper to the base.

11. The accessory system of claim 7, wherein the first topper and the second topper are magnetically coupled to the base.

12. The accessory system of claim 7, wherein the accessory is a shoe.

* * * * *